US007886672B2

(12) United States Patent
Dickner et al.

(10) Patent No.: US 7,886,672 B2
(45) Date of Patent: Feb. 15, 2011

(54) PLATFORM

(75) Inventors: Allan Dickner, Älmhult (SE); Bo Lörgård, Halmstad (SE)

(73) Assignee: Inter Ikea Systems B.V., Delft (NL)

( * ) Notice: Subject to any disclaimer, the term of this patent is extended or adjusted under 35 U.S.C. 154(b) by 808 days.

(21) Appl. No.: 11/587,392

(22) PCT Filed: Apr. 27, 2005

(86) PCT No.: PCT/SE2005/000609

§ 371 (c)(1),
(2), (4) Date: Sep. 24, 2007

(87) PCT Pub. No.: WO2005/105599

PCT Pub. Date: Nov. 10, 2005

(65) Prior Publication Data

US 2008/0190331 A1 Aug. 14, 2008

(30) Foreign Application Priority Data

Apr. 30, 2004 (SE) ..... 0401137

(51) Int. Cl.
*B65D 19/00* (2006.01)

(52) U.S. Cl. ..... 108/51.3

(58) Field of Classification Search ..... 108/51.11, 108/56.1, 51.3, 56.3, 57.16; 206/386, 599, 206/600

See application file for complete search history.

(56) References Cited

U.S. PATENT DOCUMENTS

| | | | | | |
|---|---|---|---|---|---|
| 3,043,450 | A * | 7/1962 | Caprin et al. | ..... | 206/600 |
| 4,303,020 | A | 12/1981 | Houle | | |
| 4,378,743 | A * | 4/1983 | McFarland | ..... | 108/51.3 |
| 4,610,355 | A * | 9/1986 | Maurer | ..... | 206/386 |
| 6,941,877 | B2 * | 9/2005 | Dickner | ..... | 108/51.11 |
| 7,231,879 | B2 * | 6/2007 | Gordon | ..... | 108/51.3 |
| D552,325 | S * | 10/2007 | Dickner | ..... | D34/38 |
| 2002/0069796 | A1 * | 6/2002 | Olvey et al. | ..... | 108/56.1 |
| 2007/0221536 | A1 * | 9/2007 | Sattora et al. | ..... | 206/586 |
| 2008/0017635 | A1 * | 1/2008 | Watkins | ..... | 219/730 |

FOREIGN PATENT DOCUMENTS

| | | |
|---|---|---|
| DE | 91 03 307.1 | 9/1991 |
| SE | 0202779-5 | 3/2004 |
| WO | WO 03/099660 | 12/2003 |
| WO | WO 03/099668 | 12/2003 |
| WO | WO 03/099676 | 12/2003 |
| WO | WO 2004/026713 | 4/2004 |

* cited by examiner

*Primary Examiner*—Janet M Wilkens
(74) *Attorney, Agent, or Firm*—Merchant & Gould P.C.

(57) ABSTRACT

A load carrying platform is formed by a blank of cardboard or plastic and two or more loading ledges. The platform is formed in that the blank is folded around a horizontal and a vertical leg of each loading ledge. At least a metal foot of each loading ledge is received in an opening of the blank. In some arrangements, the blank has two transversal flaps, two longitudinal flaps, and creases to facilitate folding.

22 Claims, 6 Drawing Sheets

PLATFORM

TECHNICAL FIELD

The present invention concerns a platform to be used as a support for displaying goods in a store, showroom, for transportation and storing of a number of relatively small packages etc.

PRIOR ART

Traditional pallets used for the transport of goods are often also used when the goods are to be displayed. Some special means as a trough may be placed on the pallet or the pallet may be introduced with the goods as trans-ported or stored. In recent years loading ledges have been introduced as a replacement for the traditional pallet. The loading ledges may be of the type described in our Swedish Patent Application No. 0202779-5.

SUMMARY OF THE INVENTION

One aim of the present invention is to be able to use the same loading ledges that are used for transportation and storing when displaying goods in a store, showroom etc. According to the present invention this is achieved, by combining the loading ledges with a blank of paperboard or cardboard to form a platform. Even if the blank is described as being made of cardboard, a person skilled in the art realises that any material having similarly characteristics may be used, e.g. different foldable plastic material such as corrugated or flat plastic sheeting. The blank is designed and cut to co-operate with two or more loading ledges. The same loading ledges used for transportation or storing of the goods may then be used in forming the platform for displaying the goods. Just folding the blank around the loading ledges in a suitable way forms the platform. Thus, no adhesives or other means are needed to hold the loading ledges and the blank together as one unit.

Depending on the intended use and strength needed the blank may be given different designs. By using existing loading ledges together with a blank of cardboard the costs for manufacture and storing may be kept relatively low. Furthermore, the platform may be assembled quickly and easily.

According to one aspect of the present invention the platform is load-bearing or load carrying, having both transversal and longitudinal flaps folded around the loading ledges. By folding the blank onto itself there will be two layers of cardboard, at least in parts of a support surface. The support surface is formed between the vertical legs of the loading ledges. Adjusting the length of the parts where the cardboard is double may be used to control the bearing strength. A person skilled in the art realises that the platform according to the invention may be used to support anything, as long as the bearing strength of the platform is sufficient. The platform has a low weight and yet relatively good bearing capacity and strength.

According to another aspect of the present invention the platform is not load carrying in itself. One main function of the blank in this case is to be a distance element or spacer. The length of the blank is adapted to the dimensions of the package or the like holding the goods to be displayed. These kinds of platforms are normally fixed to the bottom of the packages or the like by a tape or other adhesive.

In many instances the platforms, irrespective of type, are used also during transportation from the manufacturer and in storing. In this way there is no need for any reloading. The platform of the present invention may also be used as a basis for a number of small packages, having a size not making them suitable to use with loading ledges on their own. Thus, in such a case the platform could replace a possible plate otherwise placed between two loading ledges.

The exact form of the loading ledges is of no importance for the present invention, as long as the blank is adapted to the actual form of the loading ledges.

Further objects and advantages of the present invention will be obvious to a person skilled in the art when reading the detailed description below of preferred embodiments.

BRIEF DESCRIPTION OF THE DRAWINGS

The invention will be described further below with reference to the enclosed drawings. In the drawings.

DETAILED DESCRIPTION OF PREFERRED EMBODIMENTS

Figure 1:
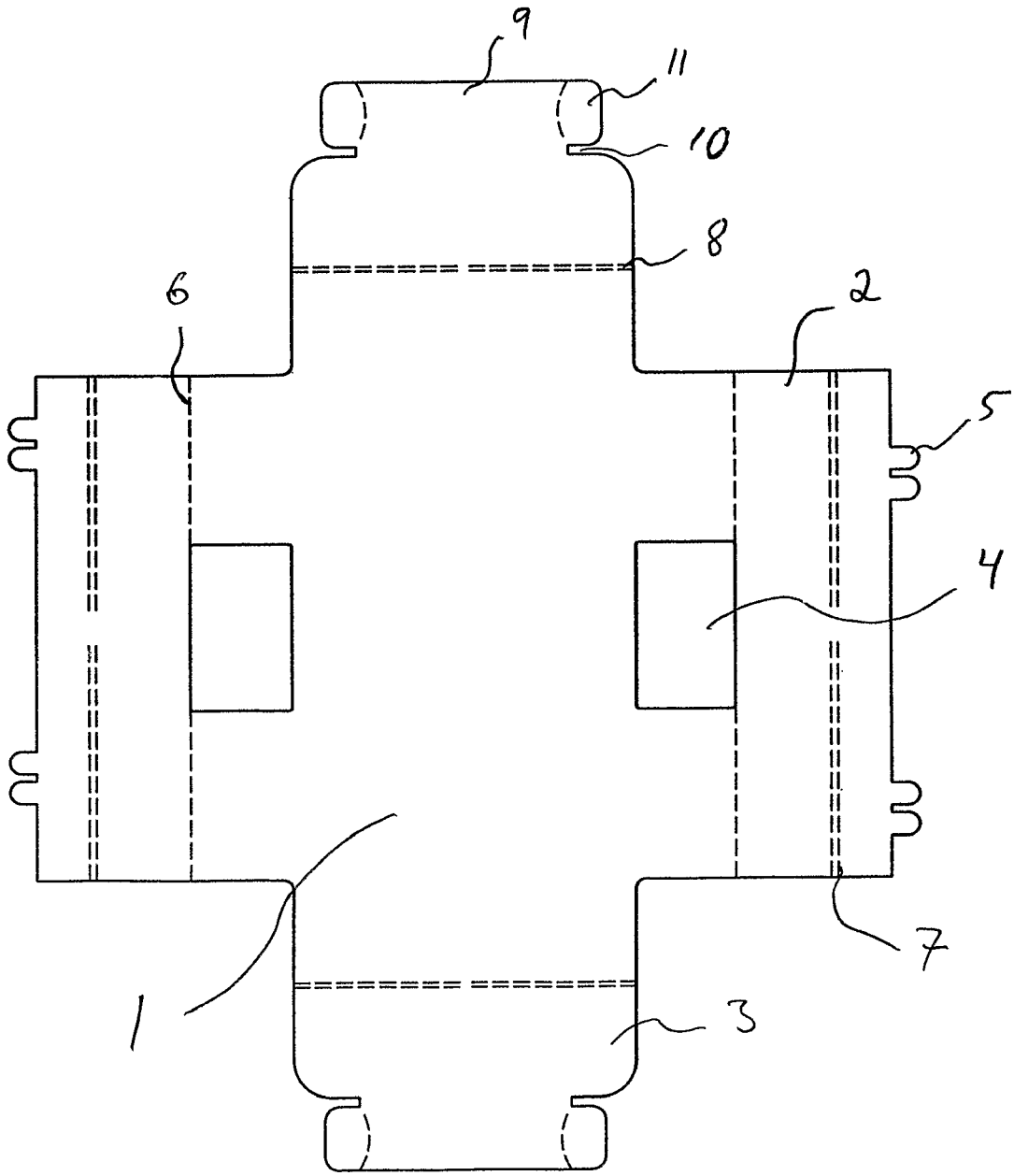
FIG. 1 is a plan view of a blank for a platform according to the present invention.

As used in this description the term "longitudinal" is the direction of the main extension of the loading ledges when the platform is formed. The term "transversal" is used correspondingly for the perpendicular direction to "longitudinal". As used in this description the terms "horizontal", "vertical" and corresponding expressions are in view of direction as shown in the enclosed drawings, which coincide with the directions in normal use.

The same reference numbers are used in the drawings for parts that are identical in the various embodiments shown.

Figure 2:
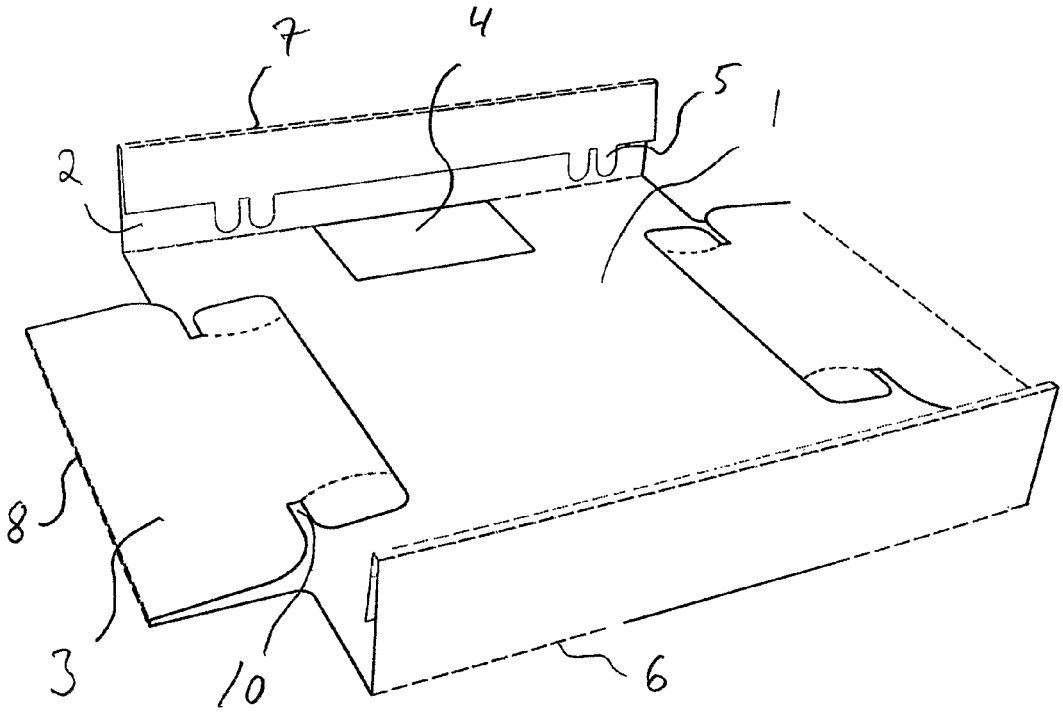
FIG. 2 is a perspective view of the blank of FIG. 1 folded in the way it will be folded to form the platform, but shown without the loading ledges for clarity.

An example of a blank 1 for a platform according to the present invention and a platform formed from the blank are shown in FIGS. 1 and 2, respectively. However, it should be noted that the platform is not intended for use on its own, but to be used with two loading ledges or the like as explained further below. The blank 1 is often made of cardboard or paperboard, i.e. corrugated paper. As indicated above, in other embodiments the blank is made of other materials, such as a corrugated or flat plastic sheet having some degree of stiffness. The shown blank 1 has two longitudinal flaps 2 and two transversal flaps 3. Inside the flaps 2, 3 a rectangular centre of the platform is formed. The longitudinal flaps 2 are arranged at the longer sides of the blank 1 and opposite each other. The transversal flaps 3 are arranged at the shorter sides of the blank 1 and opposite each other.

In the middle of each longitudinal flap 2 and adjacent the centre of the platform a rectangular opening 4 is formed. At the outer ends of the longitudinal flaps 2 a number of fingers 5 are formed. In the shown embodiment four fingers 5 are arranged at each flap 2 but the number and form of the fingers 5 may vary, depending on the design of the loading ledges or the like to be used with the platform.

Each longitudinal flap 2 has two longitudinal creases 6, 7, extending along the total length of the flaps 2. One crease 6 is arranged adjacent the rectangular opening 4 of each longitudinal flap 2. The crease 6 is arranged in such a position that the opening 4 is placed between said crease 6 and the centre of the platform. The other of the longitudinal creases 7 is a double crease placed closer to the outer end of the flap 2. The crease 7 is double in that sense that the outer end of the flap 2 is to be folded onto itself, with a part of a loading ledge 12 in-between.

The transversal flaps 3 have a crease 8 each extending parallel with the short ends of the centre of the platform and along the whole of the transversal flap 3. The crease 8 is arranged about the middle of each transversal flap 3 as shown. The length of the loading ledges 12 dictates the position of the crease 8. The short end of the horizontal leg 14 of each loading ledge 12 is to be received at the crease 8 when the transversal flap 3 is folded over. The crease 8 is double in that sense that each transversal flap 3 is to be folded onto itself, with a part of a loading ledge 12 in-between. The extension of the transversal flaps 3 may be varied, depending on the desired stability of the platform formed. This is discussed further below in connection with the embodiments of FIGS. 5 and 6.

The outer end 9 of each transversal flap 3 is less extended in the transversal direction than the rest of the flap 3. Two opposite slits 10 are arranged between the outer end 9 of each transversal flap 3 and the rest of the flap 3. The length of each slit 10 depends on the dimensions of the loading ledges to be used. A crease 11 is arranged between the inner ends of each slit 10 and the free end of the outer end 9. The parts of the outer ends 9 outside each crease 11 are to be bent down under a loading ledge, when the platform is formed.

Figure 3:
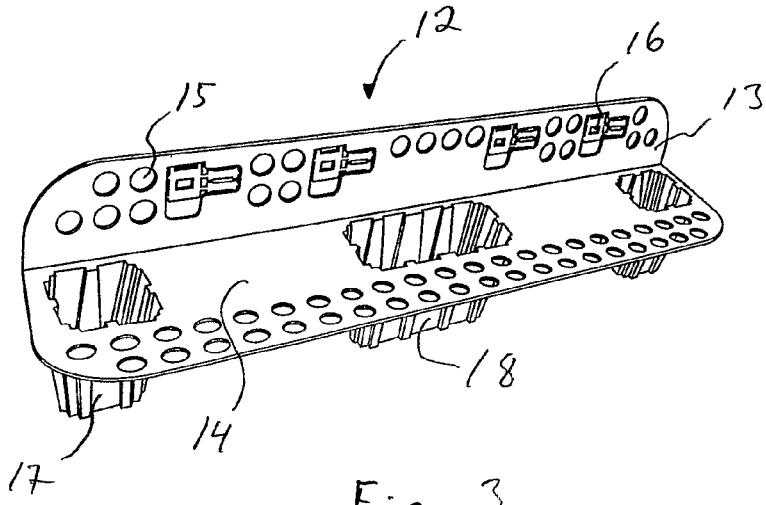
FIG. 3 is a perspective view of one example of a loading ledge possible to use with the blank of FIGS. 1 and 2.
Figure 4:
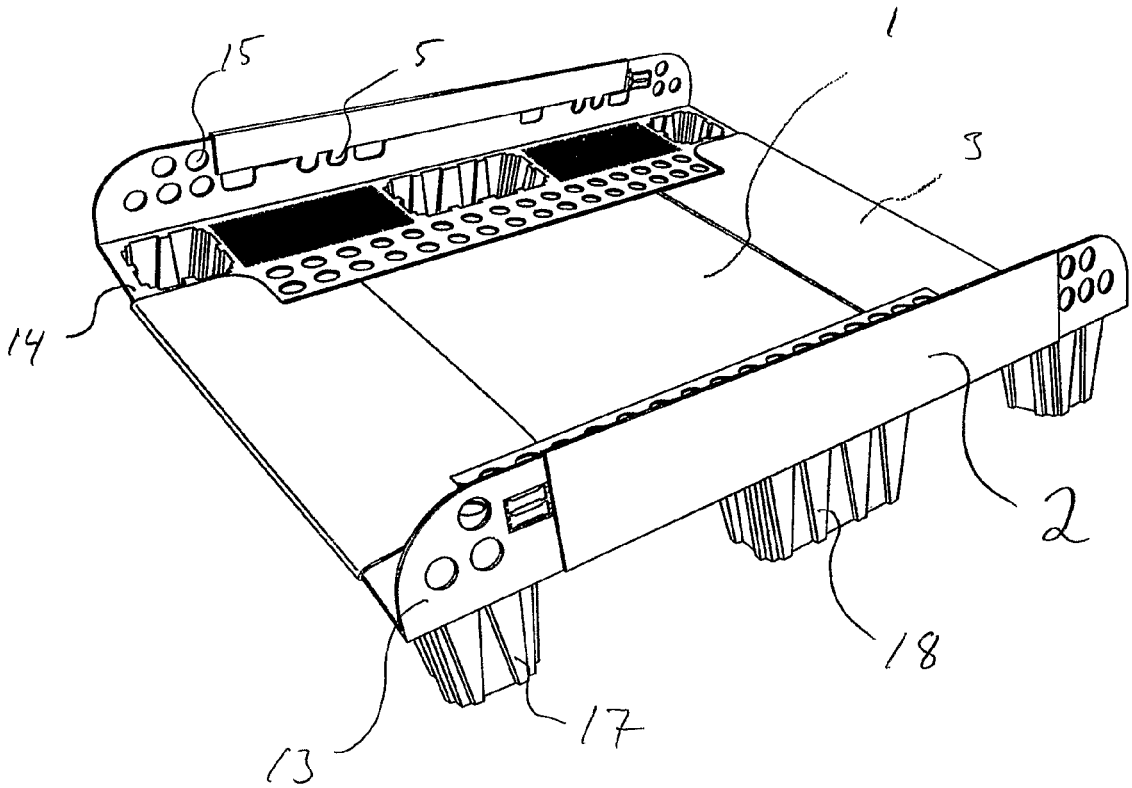
FIG. 4 is a perspective view of a platform according to the present invention formed of the blank of FIGS. 1 and 2 and two loading ledges according to FIG. 3.

In FIG. 3 one example of a loading ledge 12 is shown, which loading ledge 12 may be used with the blank of FIGS. 1 and 2 to form a platform. As indicated in FIG. 4 one blank 1 and two loading ledges 12 normally form the platform.

The loading ledges 12 have one vertical leg 13 and one horizontal leg 14. In the vertical leg 13 a number of holes 15 are arranged, originally to reduce the weight of the loading ledge 12. Furthermore, locking elements 16 for straps or the like are arranged on the vertical leg 13. On the lower side of the horizontal leg three feet 17, 18 are arranged. The feet 17, 18 are furnished to enable handling by normal handling equipment, such as different types of lift trucks. Two of the feet 17 are placed at the ends of the horizontal leg 14 and have a smaller longitudinal extent than the third foot 18 placed in the middle of the horizontal leg 14.

In use the central foot 18 of a loading ledge 12 is placed in each of the rectangular openings 4 of the longitudinal flaps 2. The feet 17 at the ends of the loading ledges 12 are normally placed adjacent the edges of the longitudinal flaps 2. In other embodiments also the feet 17 at the ends are received in openings in the blank. The outer part of the longitudinal flaps 2 is folded over the outer end of the vertical leg 13 of the loading ledge 12 at the crease 7. The fingers 5 at the outer end of the flap 2 are placed in suitable holes 15 of the loading ledge 12. In other embodiments the fingers 5 of the flaps 2 are received in holes formed at the locking elements 16. Thus, each flap 2 is held at a loading ledge 12 by co-operation between the fingers and the holes 15 of the horizontal leg 13 or the holes at the locking elements 16. With one loading ledge 12 on each side the transversal flaps 3 are folded at the crease 8 and the parts of the outer part 9 of the transversal flaps 3 outside the creases 11 are pushed down under the horizontal leg 14 of each loading ledge 12. Thus, a platform is formed comprising one blank 1 and two loading ledges 12. A support surface is formed between the vertical legs 13 of the two loading ledges 12. The dimensions of the blank 2 may be adapted to the intended use, i.e. the size of the package, container etc. to be used when displaying the goods.

Figure 5:
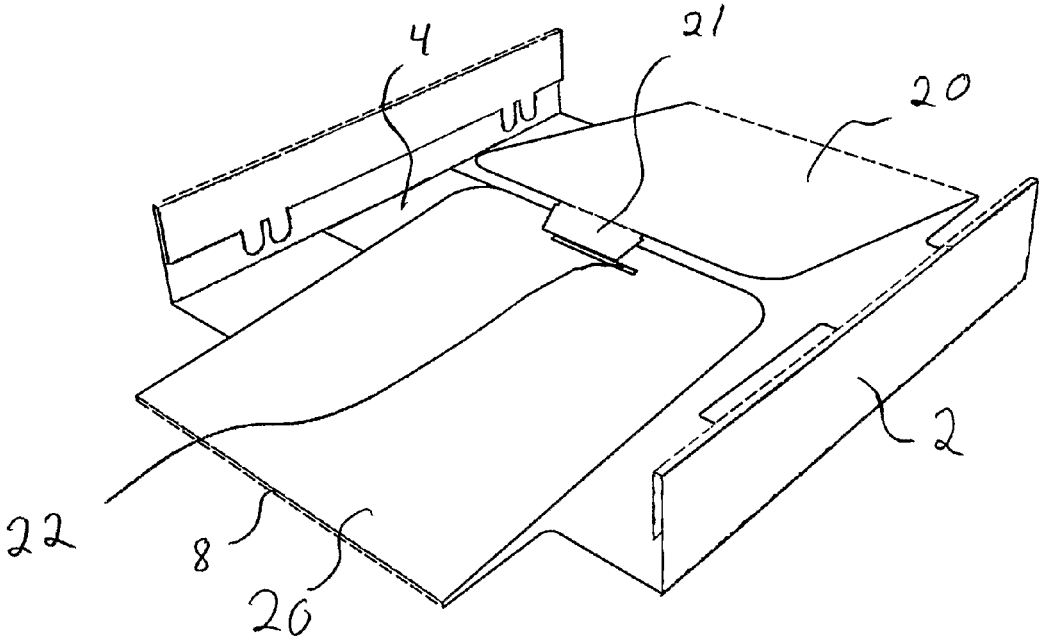
FIG. 5 is a perspective corresponding to FIG. 2 of a further embodiment of a blank according to the present invention.
Figure 6:
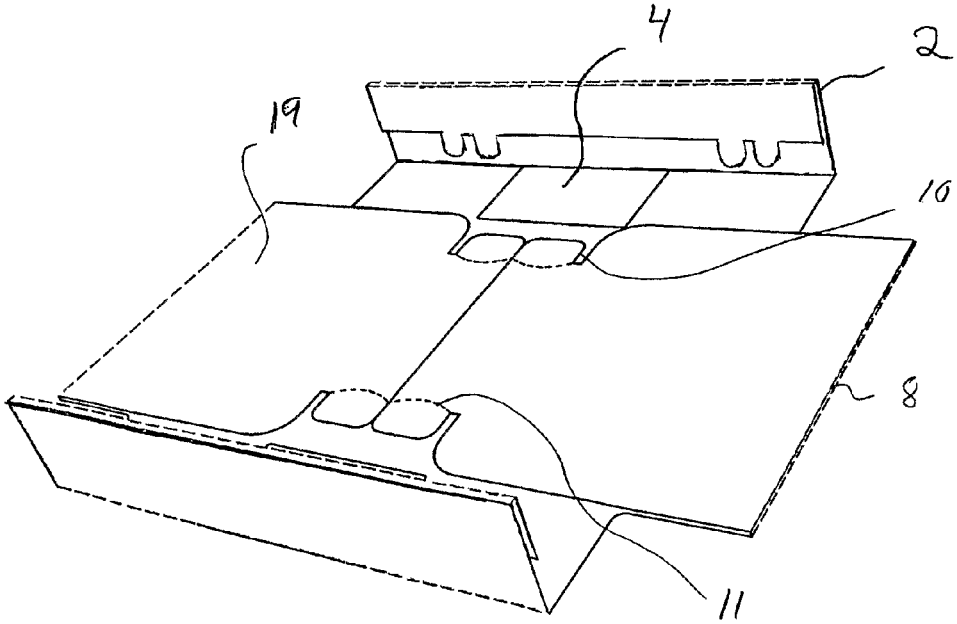
FIG. 6 is a perspective view of a further embodiment of a blank according to the present invention.

As indicated in the FIGS. 5 and 6 the length of the transversal flaps 19, 20 may vary. In the embodiments of FIGS. 5 and 6 the length of each transversal flaps 19, 20 is such that the ends of the flaps 19, 20 will be placed adjacent each other when folded to form the platform. In the embodiment of FIG. 5 a tab 21 is formed at one end of one of the transversal flaps 20. Said tab 21 is to be received in a groove 22 formed in the other transversal flap 20, when the platform is formed. In the embodiment of FIG. 5 the end of the flap 20 has the same width as the rest of the flap. Thus, no part of the transversal flap 20 is to be placed under the horizontal legs 14 of the loading ledges 12. In another embodiment (not shown), the embodiments of FIGS. 5 and 6 are combined. Thus, a tab 21 and a groove 22 are formed as in FIG. 5 while the rest of the flaps correspond to the form as shown in FIG. 6. In this latter embodiment the flaps are held down both by the co-operation between the tab 21 and the groove 22 as well as by parts of the flaps being placed under the loading ledges 12.

By means of the flaps 19, 20 having ends placed adjacent each other in the finished platform there will be two layers of cardboard over the total support surface. Double cardboard means that the bearing strength is increased compared to the other embodiments having shorter transversal flaps 3. Thus, the length of the transversal flaps 19, 20 influence the bearing strength of the platform to some extent.

Figure 7:
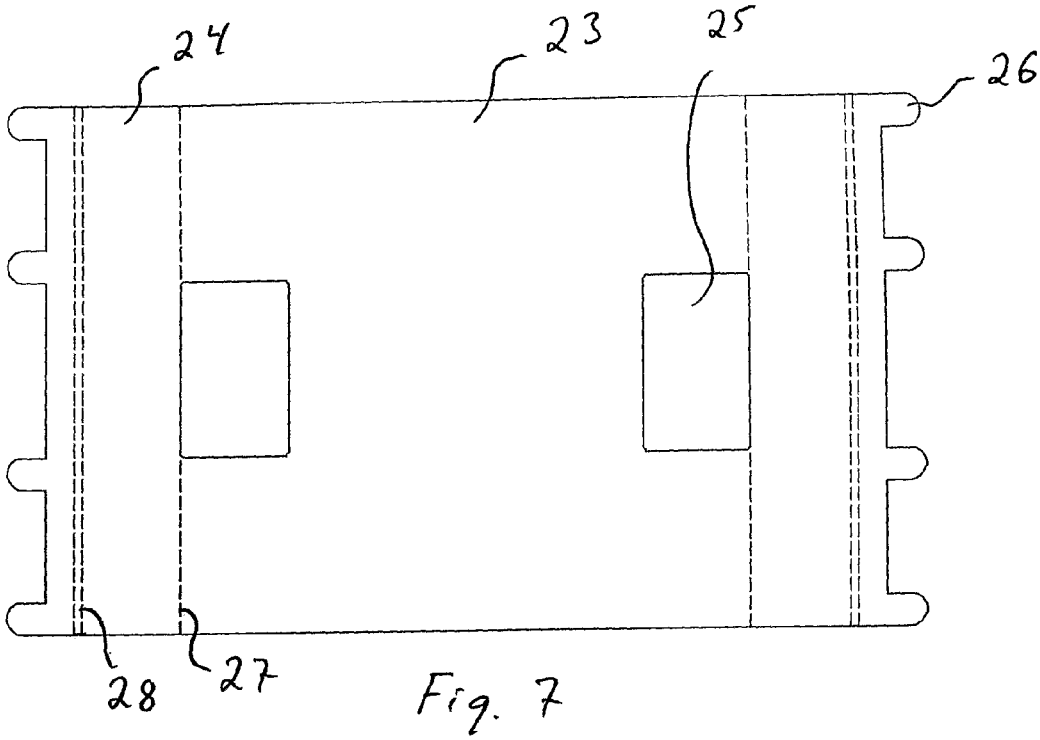
FIG. 7 is a plan view corresponding to FIG. 1 of a blank according to yet a further embodiment of the present invention.

The main difference between the blank 23 of FIG. 7 and the previously discussed blanks is that the blank 23 of FIG. 7 has no transversal flaps. It does have two longitudinal flaps 24 and two openings 25, for receiving a middle foot 18 of a loading ledge 12 each. Furthermore, it has fingers 26 at the outer, free ends of the transversal flaps 24. The fingers 26 are to be received in holes at the locking elements 16 of the vertical legs 13 of the loading ledges 12. A person skilled in the art realises that the fingers 26 as an alternative may be received in the holes 15 of the vertical leg 13 of a loading ledge 12. The position of the fingers 26 is adjusted depending on in which openings or holes 15 they are to be received. Furthermore, the blank 23 has creases 27, 28 to enable the blank to be folded around two loading ledges 12. One crease 27 is placed adjacent each opening 25, for receiving a foot 18 of the loading ledge 12, at each end of the blank 23. Said crease 27 is to be positioned adjacent the outer corner between the vertical and horizontal legs 13, 14 of respective loading ledge 12. The other crease 28 is double and the upper end of the vertical leg 13 of respective loading ledge is received at said crease 28 when the platform is formed. Each longitudinal flap 24 is to be folded onto itself with the vertical leg 13 of a loading ledge 12 in-between at said other crease 28.

Figure 8:
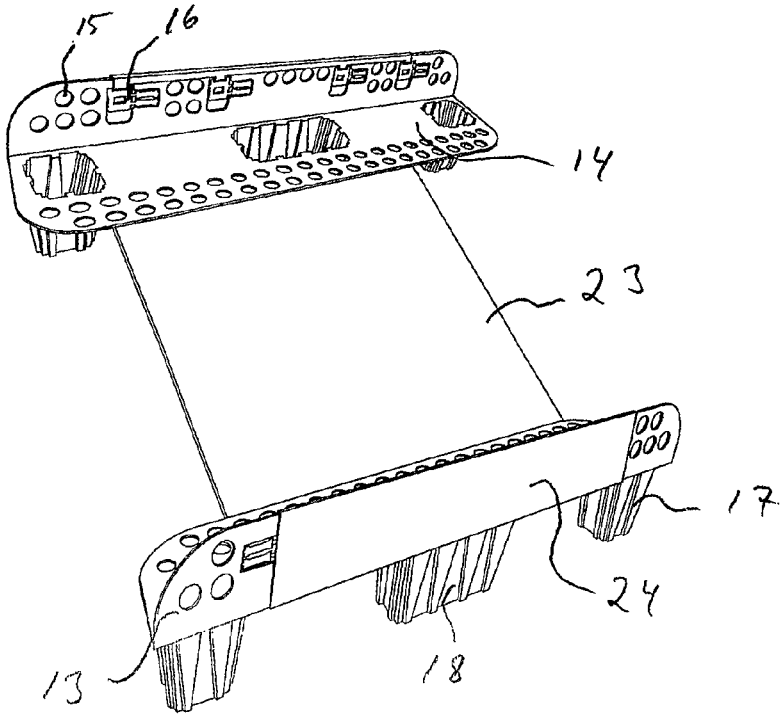
FIG. 8 is a perspective view of a platform formed by the blank of FIG. 7 and two loading ledges according to FIG. 3.

By using the blank 23 of FIG. 7 with two loading ledges 12 a platform as shown in FIG. 8 may be formed. The platform is formed in that one loading ledge 12 is placed with the middle foot 18 in each opening 25 of the blank 23. Each long side of the blank 23 is placed adjacent outer feet 17 of the loading ledges 12. Each longitudinal flap 24 is folded around the outside of each loading ledge 12 and the fingers 26 at the outer ends of the blank 23 are inserted from the inside in suitable holes 15 or at the locking elements 16. Thus, the blank 23 is held at the loading ledges 12 by means of the folding, by co-operation between the openings 25 of the blank 23 and the middle feet 18 of the loading ledges 12, and by co-operation between the fingers 26 of the blank 23 and holes 15 or openings of the vertical leg 13 of each loading ledge 12.

In use the platform of FIG. 8 is often fixed to the bottom of a package or the like holding the goods to be stored. The fixation may be in form of a tape or other adhesive. Hereby the package is used in stabilising the platform.

As an alternative the blank of FIGS. 7 and 8 may be furnished with transversal flaps to be folded into two sides of a trough. The folding of the transversal flaps would then correspond to the folding of the transversal flaps as discussed in connection with FIGS. 9 and 10 below.

In an alternative embodiment (not shown) two or more loading ledges are placed side by side on each side of the package or the like to be received. In such a case the blank is made broader and openings are provided in the blank for all feet of the loading ledges, except possibly the outer feet at each end. The principles regarding folding etc. are the same as described above with one loading ledge at each side.

Figure 9:
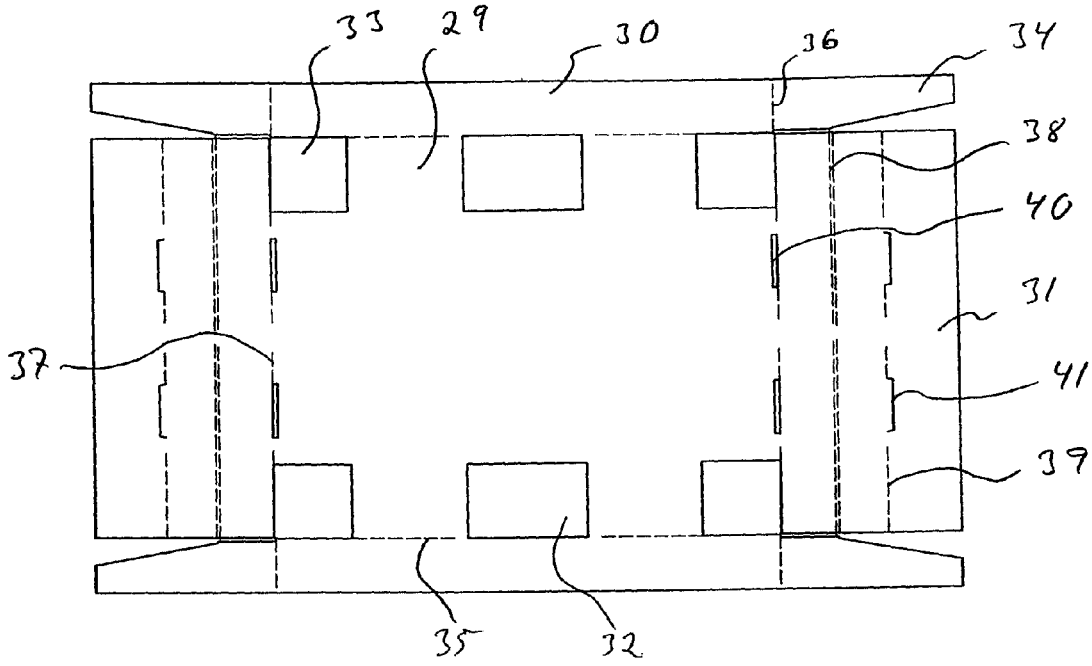
FIG. 9 is a plan view of a blank according to a further embodiment of the present invention.
Figure 10:
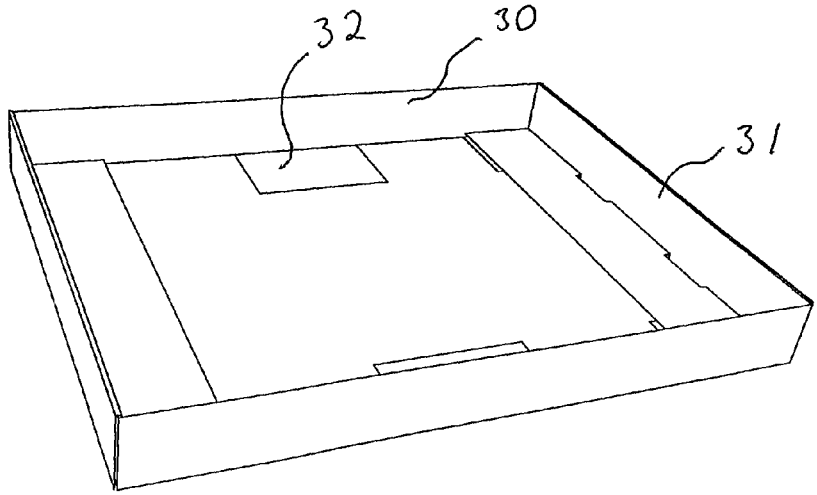
FIG. 10 is a perspective of a platform formed by the blank of FIG. 9 and without the loading ledges for clarity.

In the embodiment of FIGS. 9 and 10 the platform has the form of a trough, which may be useful if several smaller packages are received.

The blank 29 has two longitudinal flaps 30 and two transversal flaps 31. In addition to an opening 32 for each foot 18 in the middle of each loading ledge 12 it also has openings 33 for the feet 17 at the ends of each loading ledge 12. The longitudinal flaps 30 are furnished with end flaps 34 at each end having a length corresponding to the length of the transversal flaps 31. A crease 35 is arranged between each longitudinal flap 30 and the centre part of the blank 29. A crease 36 is placed between each longitudinal flap 30 and the end flaps 34.

Each transversal flap 31 has three creases, a first crease 37, between the flap 31 and the centre part of the blank 29, a second crease 38, being a double crease somewhere in the middle between the first crease 37 and a third crease 39, which third crease is placed at the same distance from the second crease 38 as the second crease 38 is placed from the first crease 37. At the first crease two notches 40 are formed for co-operation with two tabs 41 placed at the third crease 39.

The platform is formed in that the blank 29 is folded around two loading ledges 12. Each loading ledge 12 is placed with its feet 17, 18 in the appropriate openings 32, 33 of the blank 29. Then each longitudinal flap 30 is folded up against the horizontal leg 14 of the respective loading ledge 12. The end flap 34 of each longitudinal flap 30 is folded in such a way that it is placed along the first crease 37 between the respective transversal flap 3 and the centre part of the blank 29. With the end flaps 34 placed along the first crease line 37 the transversal flap 31 is folded around the end flaps 34. The part between the second and third creases 38, 39 is folded onto the part between the first and second creases 37, 38 and these parts are placed in a vertical position. The tabs 41 at the third crease 39 are at the same time placed in the notches 40 at the first crease 36 with the outer, free end of each transversal flap 31 directed inwardly at the bottom of the trough formed. By altering the length of the outer part of the transversal flaps 31 the area having double layers at the centre of the platform may be adjusted, depending on demands and requirements.

In yet a further embodiment (not shown) the platform is furnished with loading ledges on all four sides of the platform formed. The design of the blank has to be adapted to the intended use but the same principles apply. Thus, the blank is to be folded around the loading ledges in some way or other.

A person skilled in the art realises that the separate parts of the embodiments described may be combined in many different ways. From the above it is further obvious that by using a blank and folding it around two or more loading ledges a number of different designs may be achieved.

The invention claimed is:

1. A platform comprising:

(a) a blank having:

(i) two longitudinal flaps, a central part, foldable creases, and first and second openings, and first and second transversal flaps;

(b) first and second loading ledges; each of the first and second loading ledges having a vertical leg, a horizontal leg, and a central foot;

(c) wherein the blank is folded around the vertical legs and horizontal legs of the first and second loading ledges, and (i) the first opening receives one central foot of the first loading ledge, and the second opening receives one central foot of the second loading ledge;

(ii) a support surface is formed by the blank between the vertical legs of the first and second loading ledges; and (iii) portions of the blank forming the support surface include a double layer of blank.

2. The platform of claim 1, wherein two feet at the ends of the horizontal ledge of each loading ledge are to be placed just outside the transversal side of the respective longitudinal flap.

3. The platform of claim 1, wherein the outer ends of the transversal flaps are placed adjacent each other when the platform has been formed.

4. The platform of claim 3, wherein a tab is formed at the end of one of the transversal flaps, which tab is to be received in a groove in the other flap.

5. The platform of claim 1, wherein the platform has the form of a trough.

6. The platform of claim 5, wherein each longitudinal flap has an end flap, to be received inside the respective folded transversal flap at each side and that the longitudinal flap is folded against the backside of the vertical leg of respective loading ledge.

7. The platform of claim 6, wherein the outer part of each transversal flap is received at the bottom of the centre of the platform formed.

8. The platform of claim 7, wherein tabs are formed on the transversal flaps to be received in notches placed at a crease between the transversal flap and the centre of the platform.

9. The platform of claim 1, wherein the blank has openings for receiving all the feet of the loading ledges.

10. The platform of claim 1, wherein the blank is made of cardboard.

11. The platform of claim 1, wherein the blank is made of corrugated or flat plastic sheet.

12. The platform of claim 1 wherein:

(a) the first loading ledge horizontal leg has first and second short ends; and the second loading ledge horizontal leg has first and second short ends;

(b) the first transversal flap has a first crease oriented at the first short end of the horizontal leg of the first loading ledge and the first short end of the horizontal leg of the second loading ledge;

(c) the second transversal flap has a second crease oriented at the second short end of the horizontal leg of the first loading ledge and the second short end of the horizontal leg of the second loading ledge;

(d) the first transversal flap is foldable along the first crease toward a remaining portion of the blank; and (e) the second transversal flap is foldable along the second crease toward a remaining portion of the blank.

13. The platform of claim 12 wherein:

(a) the first transversal flap includes:

(i) a slit with first and second inner ends;

(ii) an outer end; the outer end being smaller than a remaining portion of the first transversal flap;

(A) the outer end having first and second free ends;

(B) the outer end having a first crease between the first inner end of the slit and the first free end of the outer end;

(C) the outer end having a second crease between the second inner end of the slit and the second free end of the outer end;

(D) the outer end having a first part between the first crease and the first outer end; the first part being oriented under the horizontal leg of the first loading ledge;

(E) the outer end having a second part between the second crease and the second outer end; the second part being oriented under the horizontal leg of the second loading ledge; and (b) the second transversal flap includes:

(i) a slit with first and second inner ends;

(ii) an outer end; the outer end being smaller than a remaining portion of the second transversal flap;

(A) the outer end having first and second free ends;

(B) the outer end having a first crease between the first inner end of the slit and the first free end of the outer end;

(C) the outer end having a second crease between the second inner end of the slit and the second free end of the outer end;

(D) the outer end having a first part between the first crease and the first outer end; the first part being oriented under the horizontal leg of the first loading ledge;

(E) the outer end having a second part between the second crease and the second outer end; the second part being oriented under the horizontal leg of the second loading ledge.

14. The platform of claim 1 further comprising:

(a) the first longitudinal flap includes means to attach the first longitudinal flap to the first loading ledge; and (b) the second longitudinal flap includes means to attach the second longitudinal flap to the second loading ledge.

15. The platform of claim 14 wherein:

(a) the means to attach the first longitudinal flap to the first loading ledge includes a plurality of fingers projecting from a side of the first longitudinal flap; the plurality of fingers cooperating with holes in the first loading ledge vertical leg; and (b) the means to attach the second longitudinal flap to the second loading ledge includes a plurality of fingers projecting from a side of the second longitudinal flap; the plurality of fingers cooperating with holes in the second loading ledge vertical leg.

16. A platform comprising:

(a) first and second loading ledges; each first and second loading ledge having a vertical leg, a horizontal leg, and a central foot;

(i) each vertical leg of the two loading ledges having an upper edge;

(b) a blank folded around the legs of the two loading ledges; the blank having:

(i) first and second longitudinal flaps; the first longitudinal flap being folded around the first loading ledge vertical leg; the second longitudinal flap being folded around the second loading ledge vertical leg;

(A) the first longitudinal flap including means to attach the first longitudinal flap to the first loading ledge;

(B) the second longitudinal flap including means to attach the second longitudinal flap to the second loading ledge;

(ii) a central part;

(iii) a first foldable crease positioned at the upper edge of the first loading ledge vertical leg, and a second foldable crease positioned at the upper edge of the second loading ledge vertical leg; and (iv) first and second openings; the first opening receiving the central foot the first loading ledge, and the second opening receiving the central foot of the second loading ledge.

17. The platform of claim 16, wherein the blank forms a single layer in the area between the loading ledges when the platform is formed and that the blank is fixed by means of tape or other adhesive to the package or the like received on the platform.

18. The platform of claim 16, wherein the blank is made of cardboard.

19. The platform of claim 16, wherein the blank is made of corrugated or flat plastic sheet.

20. The platform of claim 16 wherein the blank further includes first and second transversal flaps.

21. The platform of claim 20 wherein:

(a) the first loading ledge horizontal leg has first and second short ends; and the second loading ledge horizontal leg has first and second short ends;

(b) the first transversal flap has a first crease oriented at the first short end of the horizontal leg of the first loading ledge and the first short end of the horizontal leg of the second loading ledge;

(c) the second transversal flap has a second crease oriented at the second short end of the horizontal leg of the first loading ledge and the second short end of the horizontal leg of the second loading ledge;

(d) the first transversal flap is foldable along the first crease toward a remaining portion of the blank; and (e) the second transversal flap is foldable along the second crease toward a remaining portion of the blank.

22. The platform of claim 21 wherein:

(a) the first transversal flap includes:

(i) a slit with first and second inner ends;

(ii) an outer end; the outer end being smaller than a remaining portion of the first transversal flap;

(A) the outer end having first and second free ends;

(B) the outer end having a first crease between the first inner end of the slit and the first free end of the outer end;

(C) the outer end having a second crease between the second inner end of the slit and the second free end of the outer end;

(D) the outer end having a first part between the first crease and the first outer end; the first part being oriented under the horizontal leg of the first loading ledge;

(E) the outer end having a second part between the second crease and the second outer end; the second part being oriented under the horizontal leg of the second loading ledge; and (b) the second transversal flap includes:

(i) a slit with first and second inner ends;

(ii) an outer end; the outer end being smaller than a remaining portion of the second transversal flap;

(A) the outer end having first and second free ends;

(B) the outer end having a first crease between the first inner end of the slit and the first free end of the outer end;

(C) the outer end having a second crease between the second inner end of the slit and the second free end of the outer end;

(D) the outer end having a first part between the first crease and the first outer end; the first part being oriented under the horizontal leg of the first loading ledge;

(E) the outer end having a second part between the second crease and the second outer end; the second part being oriented under the horizontal leg of the second loading ledge.

* * * * *